US007094013B2

(12) United States Patent
Hart et al.

(10) Patent No.: US 7,094,013 B2
(45) Date of Patent: Aug. 22, 2006

(54) ALUMINUM VEHICLE CARRIER RAILCAR

(75) Inventors: James D. Hart, Grove City, PA (US); Mark L. Saylor, Davidsville, PA (US); William A. Wiles, Johnstown, PA (US)

(73) Assignee: JAC Patent Company, Johnstown, PA (US)

( * ) Notice: Subject to any disclaimer, the term of this patent is extended or adjusted under 35 U.S.C. 154(b) by 97 days.

(21) Appl. No.: 10/380,643

(22) PCT Filed: Sep. 17, 2001

(86) PCT No.: PCT/US01/42207

§ 371 (c)(1),
(2), (4) Date: Jul. 11, 2003

(87) PCT Pub. No.: WO02/22394

PCT Pub. Date: Mar. 21, 2002

(65) Prior Publication Data

US 2005/0031430 A1 Feb. 10, 2005

Related U.S. Application Data

(60) Provisional application No. 60/233,027, filed on Sep. 15, 2000.

(51) Int. Cl.
*B60P 7/08* (2006.01)

(52) U.S. Cl. ..... 410/26; 410/24; 105/355

(58) Field of Classification Search ..... 410/4, 410/24, 26; 105/355, 375, 378, 380
See application file for complete search history.

(56) References Cited

U.S. PATENT DOCUMENTS

| | | | | |
|---|---|---|---|---|
| 3,017,840 | A | | 1/1962 | Fairweather |
| 3,240,167 | A | | 3/1966 | Podesta et al. |
| 3,709,154 | A | | 1/1973 | Peisner et al. |
| 3,815,517 | A | | 6/1974 | Przybylinski |
| 4,059,056 | A | | 11/1977 | Berryman et al. |
| 4,343,401 | A | * | 8/1982 | Paulyson |
| 4,631,891 | A | * | 12/1986 | Donavich |
| 4,860,911 | A | * | 8/1989 | Jones, Sr. |
| 4,913,061 | A | * | 4/1990 | Youngblood |
| 5,525,026 | A | * | 6/1996 | DeMonte et al. |
| 5,669,745 | A | * | 9/1997 | Anderson ..... 410/87 |
| 5,765,486 | A | * | 6/1998 | Black et al. |
| 6,302,031 | B1 | * | 10/2001 | Smith et al. |
| 6,367,391 | B1 | * | 4/2002 | Thoman et al. |
| 6,446,561 | B1 | * | 9/2002 | Khattab |
| 6,467,118 | B1 | * | 10/2002 | Dumlao et al. |

* cited by examiner

*Primary Examiner*—Stephen Gordon
(74) *Attorney, Agent, or Firm*—Blynn L. Shideler; Krisanne Shideler; BLK Law Group

(57) ABSTRACT

A bi-level aluminum vehicle carrier railcar (10) includes an integrated aluminum roofing structure (30), aluminum side panels (18, 20), and aluminum decking structure (36, 50) attached to a steel underframe. The decking structure (36, 50) is supported on side stakes (18) of the side panels (18, 20) with the decking structure (36, 50) including overlapping extruded aluminum decking plates with (38, 52) anti-skid features. The anti-skid features include a media blasted finish to a portion of the surface of the decking and extruded ribs (64) in a portion of the decking. The roofing structure (30) includes overlapping, arched corrugated aluminum panels (30), wherein the roof panels (30) remain uncoated.

13 Claims, 14 Drawing Sheets

ALUMINUM VEHICLE CARRIER RAILCAR

The present application claims the benefit of now abandoned Provisional Application Ser. No. 60/233,027, filed Sep. 15, 2000, entitled "Aluminum Vehicle Carrier Railcar" which is incorporated herein by reference.

BACKGROUND OF THE INVENTION

1. Field of the Invention

The present invention relates to railcars for transporting vehicles, typically also called vehicle carriers, and more particularly, directed toward aluminum vehicle carrier railcars.

2. Background Information

Railcars have long been used for transporting vehicles, in particular automobiles and light trucks, long distances generally from the point of manufacture or import location to dealerships or locations where the automobiles or trucks can be subsequently transported by truck. As with other freight, a vehicle carrying railcar is designed to carry a maximum number of motor vehicles in each railcar. This has lead to the development of a bi-level or tri-level vehicle carrier railcar. In addition to the desire to carry a maximum number of vehicles on each vehicle carrier railcar, the existing railcars have been designed to minimize damage or vandalism of the vehicles such that many vehicle carrying railcars are designed as an enclosed structure.

Conventionally, the existing vehicle carrier railcars are formed of steel. The steel enclosure found in conventional vehicle carrier railcars presents other problems for the railcar. Steel is susceptible to oxidation, i.e., rust or corrosion, which can be particularly damaging to the top coat and finish coat of new automobiles or trucks contained within the interior of the railcar. To avoid this problem, conventional steel vehicle carrier railcars are painted to provide a protected area between the steel and the automobiles carried in the railcar interior. The painting of the interior of the vehicle carrier railcar requires a certain amount of material and labor at manufacturing. More significantly, the painted surfaces introduce significant maintenance requirements for the vehicle carrier railcars. The vehicle carrier railcars must be periodically repainted to maintain the appropriate protection or barrier layer between the steel car and the carried vehicles. This repainting is labor-intensive, time consuming and holds the associated railcar out of service during the maintenance procedure. Some attempts have been made to address this solution such as a fiberglass panel articulated railcar disclosed in U.S. Pat. No. 5,511,491 assigned to Trinity.

In addition to painting of the interior surface to provide a barrier layer between the steel vehicle carrier railcars and the automobiles carried in the interior, the prior art railcars often utilize an anti-skid paint on the decking surfaces to accommodate pedestrian traffic. This specialized paint further increases the cost of the prior art railcars. The non-skid paint is provided since the decking, at least selected portions of the decking, is utilized as a walkway for workers loading and unloading vehicles onto the vehicle carrier.

The object of the present invention is to address the problems of the above-cited prior art. It is a further object of the present invention to provide a lightweight vehicle carrier railcar constructed from non-corroding materials adjacent to the load carrying interior. A further object of the present invention is to provide an efficient, cost-effective, non-slip area for workers loading and unloading vehicles from the vehicle carrier. Another object of the present invention is to provide a lightweight uni-body vehicle carrier railcar.

SUMMARY OF THE INVENTION

The above objects are achieved with an aluminum vehicle carrier railcar according to the present invention. The railcar according to the present invention utilizes underframe components constructed principally of steel and an upper body comprised principally of aluminum components to create a uni-body design. The steel underframe components that could potentially introduce ferrous components inside the railcar are covered with aluminum. Aluminum components that could be utilized as walkways are either blasted with media or incorporate non-slip surfaces in extruded sections to provide unpainted permanent walkways for workers loading and unloading the railcar.

Specifically, the aluminum vehicle carrier railcar will include an underframe utilizing a two-piece cast steel draft sill, a roll formed steel center sill with other steel underframe components. The aluminum upper structure includes aluminum side sheets, aluminum side stakes, aluminum curb plates and aluminum top chords forming the side panels. The side panels are mechanically fastened to the underframe and to corrugated aluminum roof sheets. Extruded aluminum deck sections extend between the curb plates to form the upper deck, to form the bi-level vehicle carrier of the present invention. Pivotable end doors are provided at both ends of the railcar.

These and other advantages of the present invention will be clarified in the detailed description of the preferred embodiment together with the attached figures in which like reference numerals represent like elements throughout.

DETAILED DESCRIPTION OF THE PREFERRED EMBODIMENT

Figure 1:
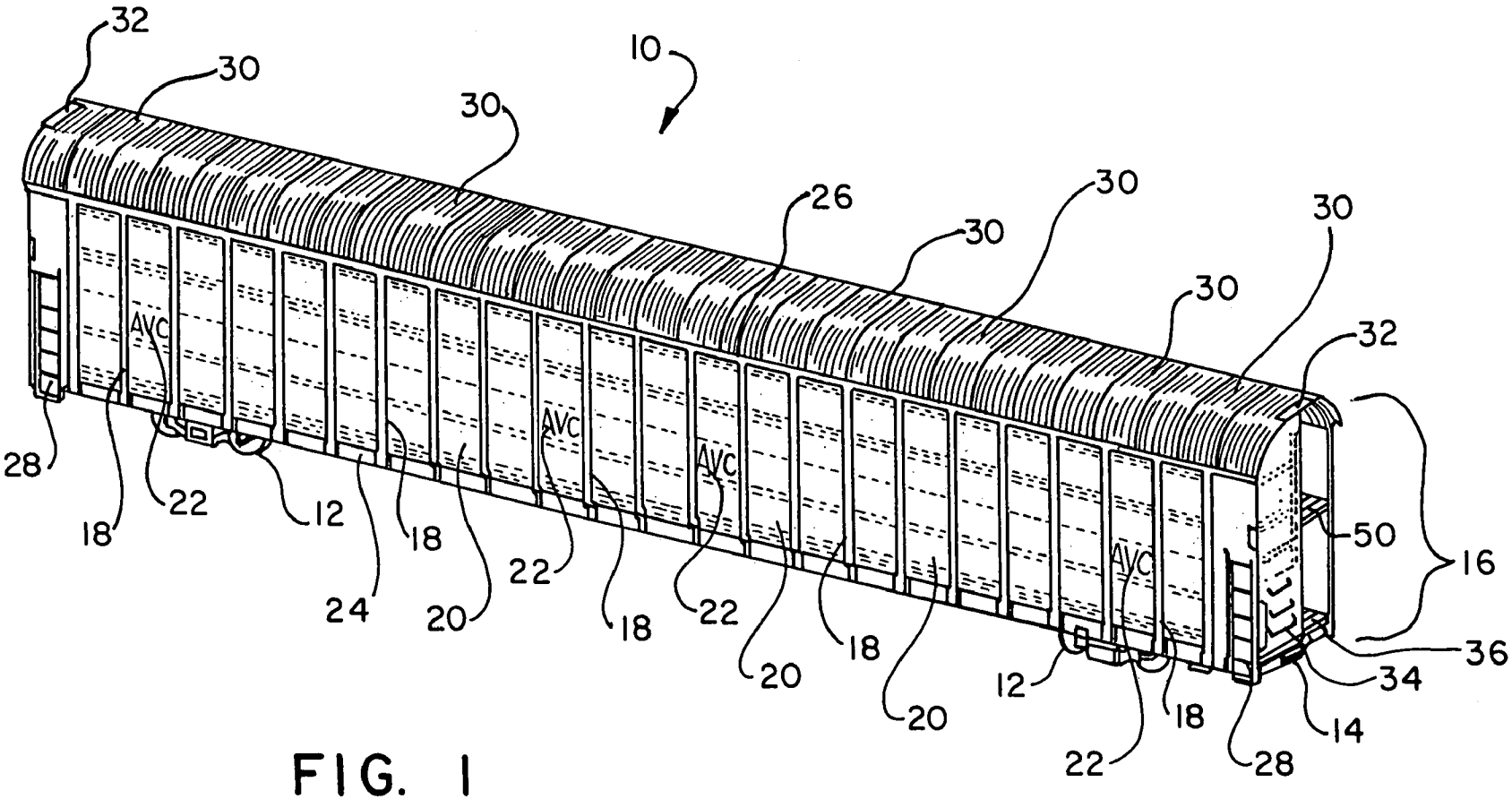
FIG. 1 is a perspective view of an aluminum vehicle carrier railcar according to the present invention.
Figure 2:
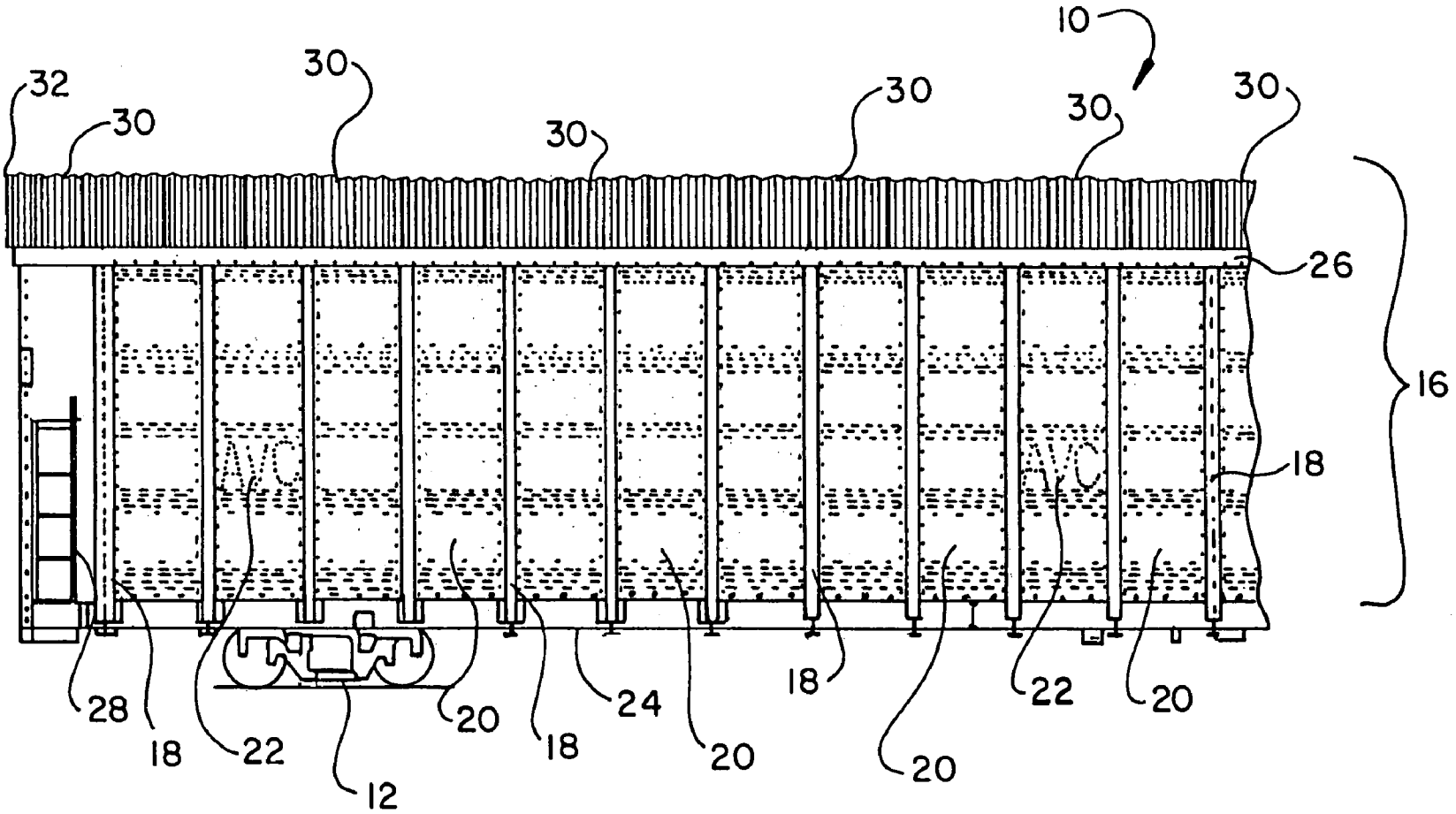
FIG. 2 is a left half elevational side view of the vehicle carrier railcar shown in FIG. 1.
Figure 3:
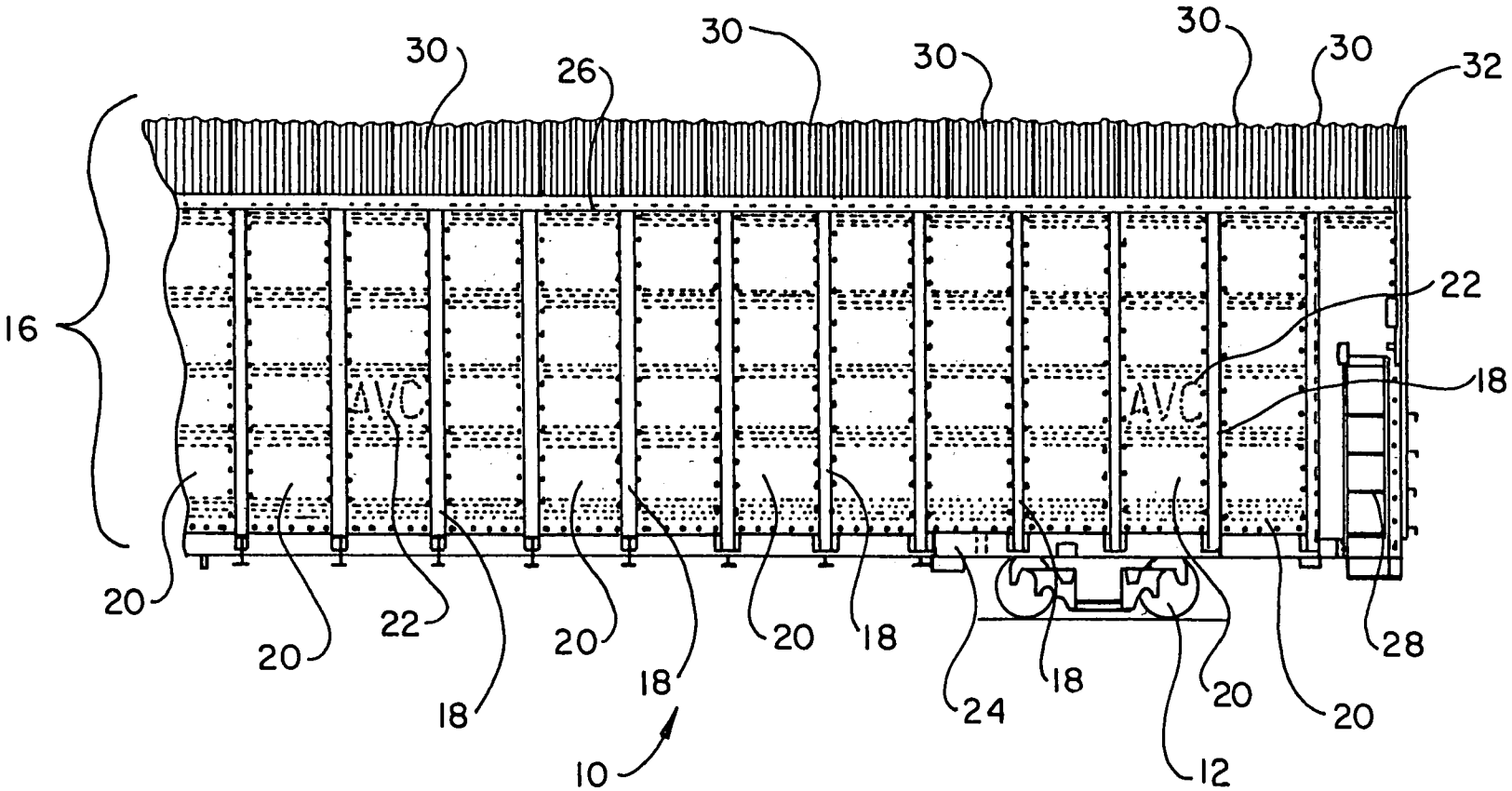
FIG. 3 is a right half elevational side view of the vehicle carrier railcar shown in FIG. 1.

An aluminum vehicle carrier railcar 10 according to the present invention is illustrated in FIGS. 1–22. The aluminum vehicle carrier railcar 10 of the present invention utilizes a steel underframe (not completely shown) supported on a pair of spaced trucks 12. The steel underframe may be formed with a pair of two-piece cast steel draft sills 14 (also called draft arms), a roll formed center sill (not shown) extending between the trucks 12 and other steel underframe components. The center sill is described in U.S. Pat. No. 6,119,345, which is incorporated herein by reference.

An aluminum upper structure 16 is attached onto the steel underframe. The aluminum upper structure 16 includes a pair of spaced side panels shown in detail in FIGS. 2–4. The side panels include a plurality of spaced aluminum side stakes 18 extending the length of the aluminum vehicle carrier railcar 10. Perforated aluminum side sheets 20 extend between and are attached to each adjacent pair of side stakes 18 to form the side panel structure. The side sheets 20 are attached by mechanical fasteners to the side stakes 18, or possibly by other coupling mechanisms such as welding. The side sheets 18 are perforated allowing ventilation to the cargo area of the railcar 10. Additionally, the invention anticipates utilizing the perforations to provide identifying indicia 22 on the vehicle carrier railcar 10 which may be in the form of a logo or other text or graphical information.

Figures 4, 5:
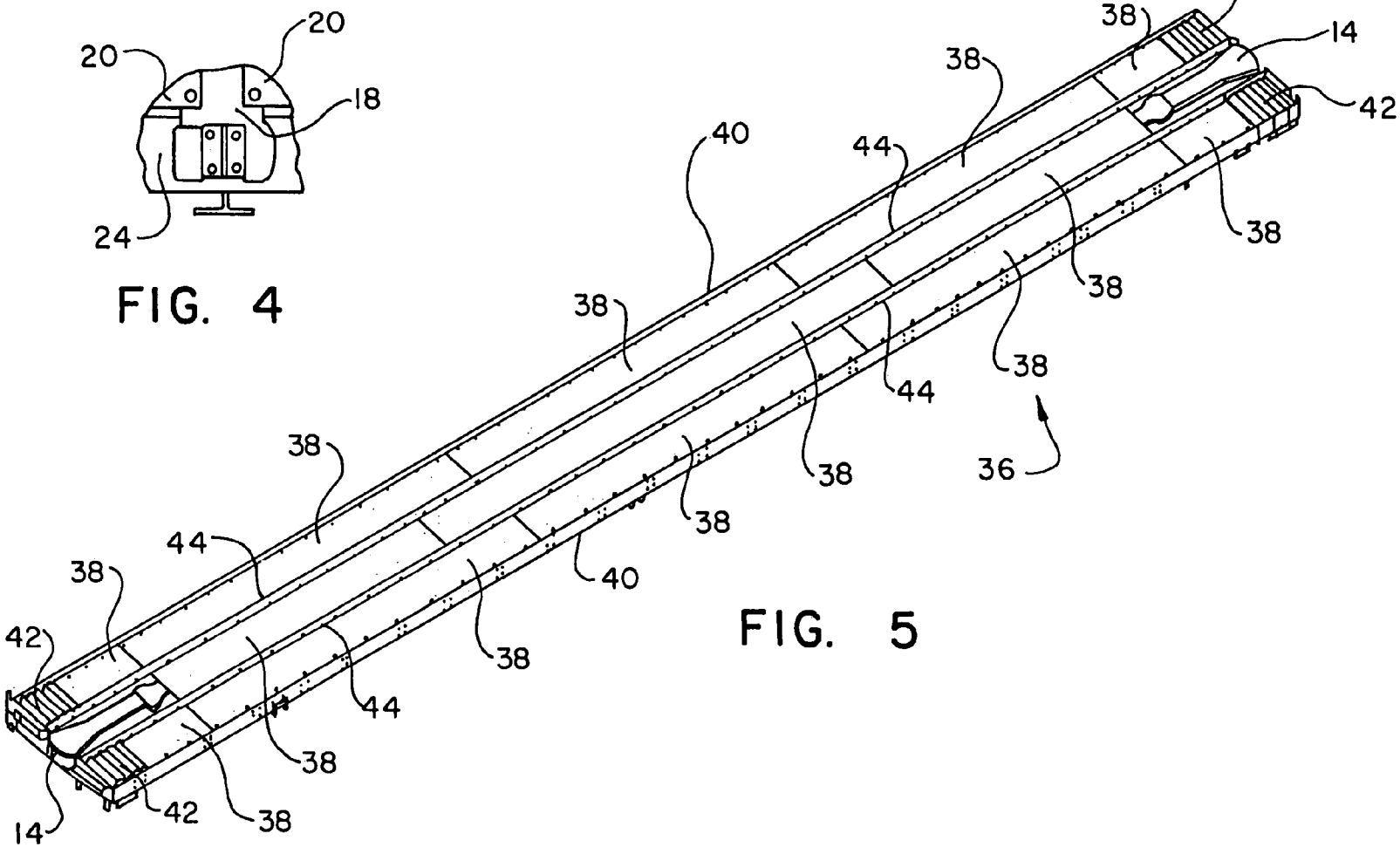
FIG. 4 is an enlarged view of a connection between a side stake of a side panel and a side sill of the vehicle carrier railcar shown in FIG. 1.
FIG. 5 is a perspective view of a lower deck of the vehicle carrier railcar shown in FIG. 1.

The side stakes 18 and the side sheets 20 extend between a side sill 24 and a top chord 26. The side stakes 18 are attached to the side sill 26 by mechanical fasteners as shown in FIG. 4. The side panel is attached to the top chord 26 through mechanical fasteners as well. Other coupling mechanism may be also be utilized. The top chord 26 and side sills 24 extend the length of the vehicle carrier railcar 10. The ends of the side panels include access ladders 28.

The aluminum vehicle carrier railcar 10 additionally includes a roof structure or roof system formed of overlapping corrugated and rolled aluminum panels 30 extending between and attached to the top chord 26 through mechanical fasteners. The details of the individual roof panels 30 are shown in FIGS. 19–22. The overlapped ends of adjacent panels 30 may be fastened together with mechanical fasteners through the aligned holes. The ends of the roof structure may include roof latch strikers 32 as shown in FIG. 1 to assist in the closure of end doors 34.

Corner posts are provided at the end of the side panel structure extending between the side sill 24 and the top chord 26 to provide a mounting position for the pivotable end doors 34. The doors 34, the side panel structures and the roof structure combine to form an enclosed cargo area for the aluminum vehicle carrier railcar 10. The interior compartment of the aluminum vehicle carrier 10 includes an aluminum decking and other aluminum components to prevent any substantial ferrous material from being exposed to the vehicles in the cargo area.

Figure 6:
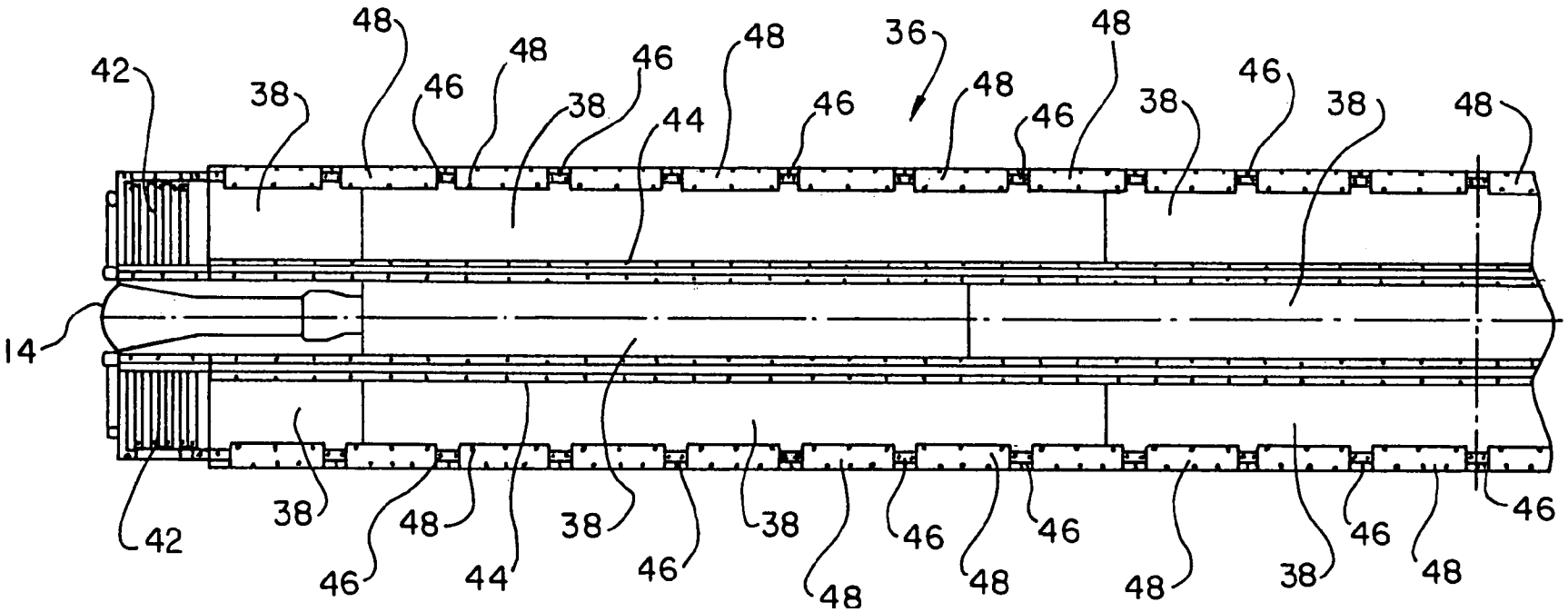
FIG. 6 is a left half plan view of the lower deck and side panel attachment of the vehicle carrier railcar shown in FIG. 5.
Figure 7:
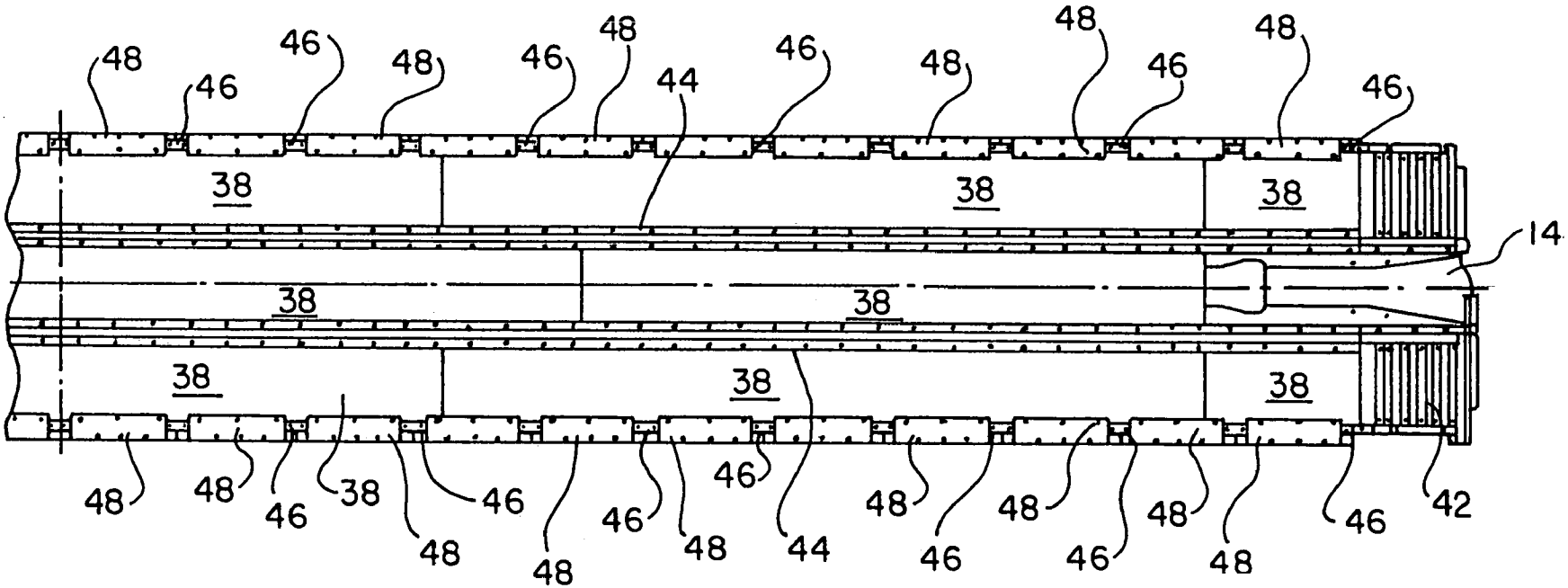
FIG. 7 is a right half plan view of the lower deck and side panel attachment of the vehicle carrier railcar shown in FIG. 5.

The details of a lower deck 36 (Also referred to as a decking or decking system) are shown in FIGS. 5–11. As shown in FIGS. 5–7, the lower deck 36 includes a plurality of aluminum deck panels 38 secured to components of a sub-floor 40. Ramp panels 42 are provided at the ends of the lower deck 36. The lower deck 36 includes tire guides 44 to assist the loading of vehicles and light trucks. A key feature of the present invention is that the top surface of the panels 38 and 42 are blasted with media, e.g., grit or the like, to provide a non-slip surface or walkway for those walking in the cargo area of the railcar 10. The roughened surface provided by media blasting eliminates the need for preparing the deck surface for painting with a non-slip paint or otherwise applying a non-slip tread. This is believed to decrease the manufacturing and maintenance cost of the railcar 10. The upper surface of the draft sill 14 may be thermo-sprayed or otherwise coated or covered to protect the cargo area of the railcar.

The present invention encompasses a process that provides a surface condition on the aluminum panels 38 and 42 whereby the coefficient of friction between the metal surface and the material that contacts it is increased. This will create a permanent, non-skid or non-slip metallic surface for automobile and pedestrian traffic. The process can be utilized for other metal plates, extrusions and structural shapes to provide the rough and non-skid or non-slip surface. The proposed method is to impact the aluminum or other metal surfaces in a media blasting process, e.g. grit blasting or the like, to modify the surface condition of the metal. The exact surface profile and texture can vary in order to provide the proper frictional coefficient for the desired application. The media blasting can be performed by conventional, mechanical or pneumatic systems.

Figure 8:
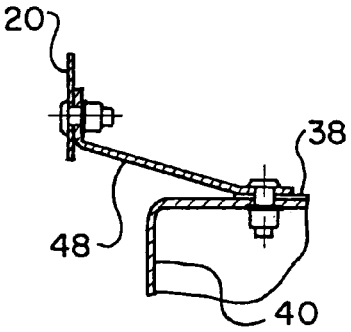
FIG. 8 is an enlarged sectional view of a portion of the lower deck and side panel attachment of the vehicle carrier railcar shown in FIG. 7.
Figure 9:
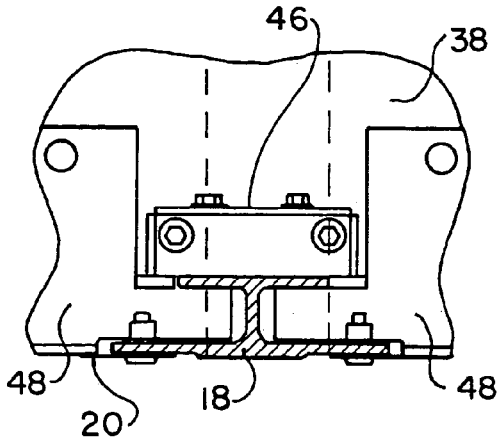
FIG. 9 is an enlarged view of a portion of the lower deck and side panel attachment of the vehicle carrier railcar shown in FIG. 7.
Figure 11:
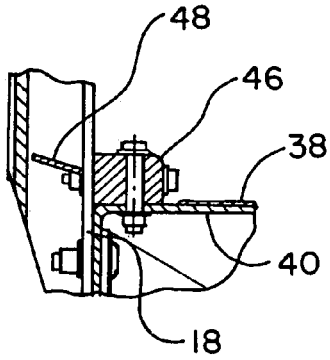
FIG. 11 is a sectional view of a portion of the lower deck and side panel attachment of the vehicle carrier railcar shown in FIG. 9.
Figure 10:
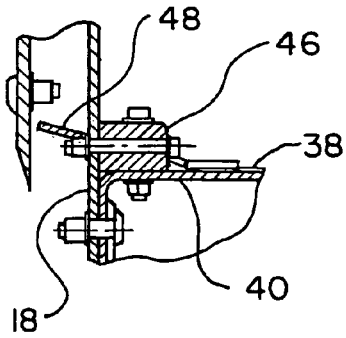
FIG. 10 is a sectional view of a portion of the lower deck and side panel attachment of the vehicle carrier railcar shown in FIG. 9.
Figure 12:
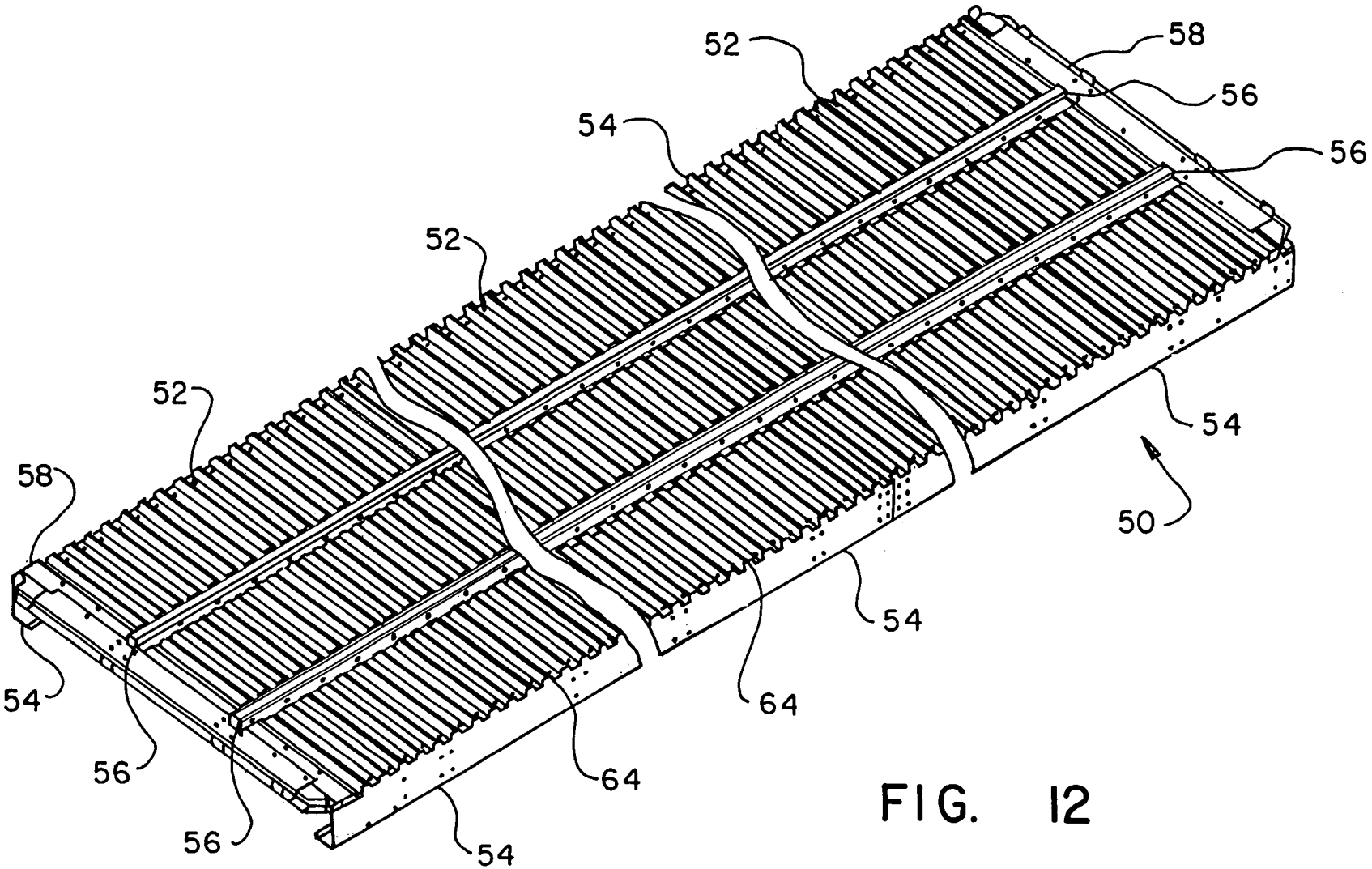
FIG. 12 is a perspective view of an upper deck of the vehicle carrier railcar shown in FIG. 1.
Figure 13:
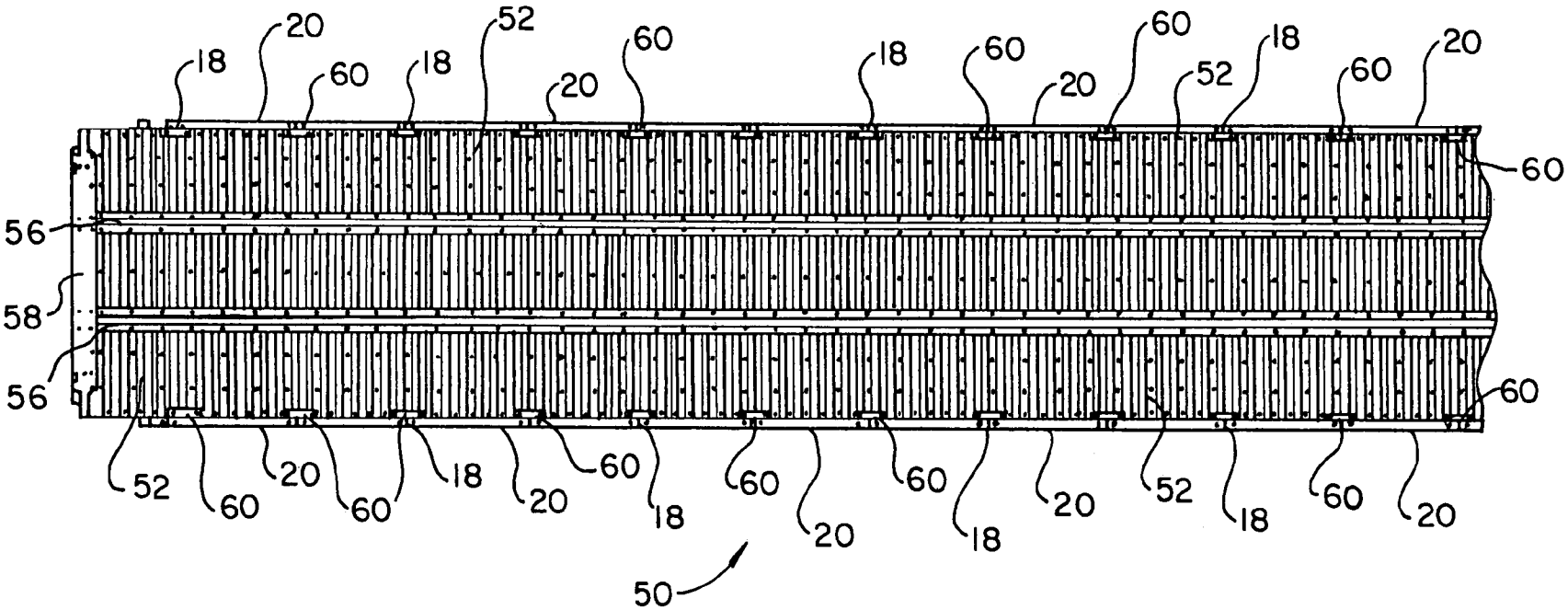
FIG. 13 is a left half plan view of the upper deck and side panel attachment of the vehicle carrier railcar shown in FIG. 12.
Figure 14:
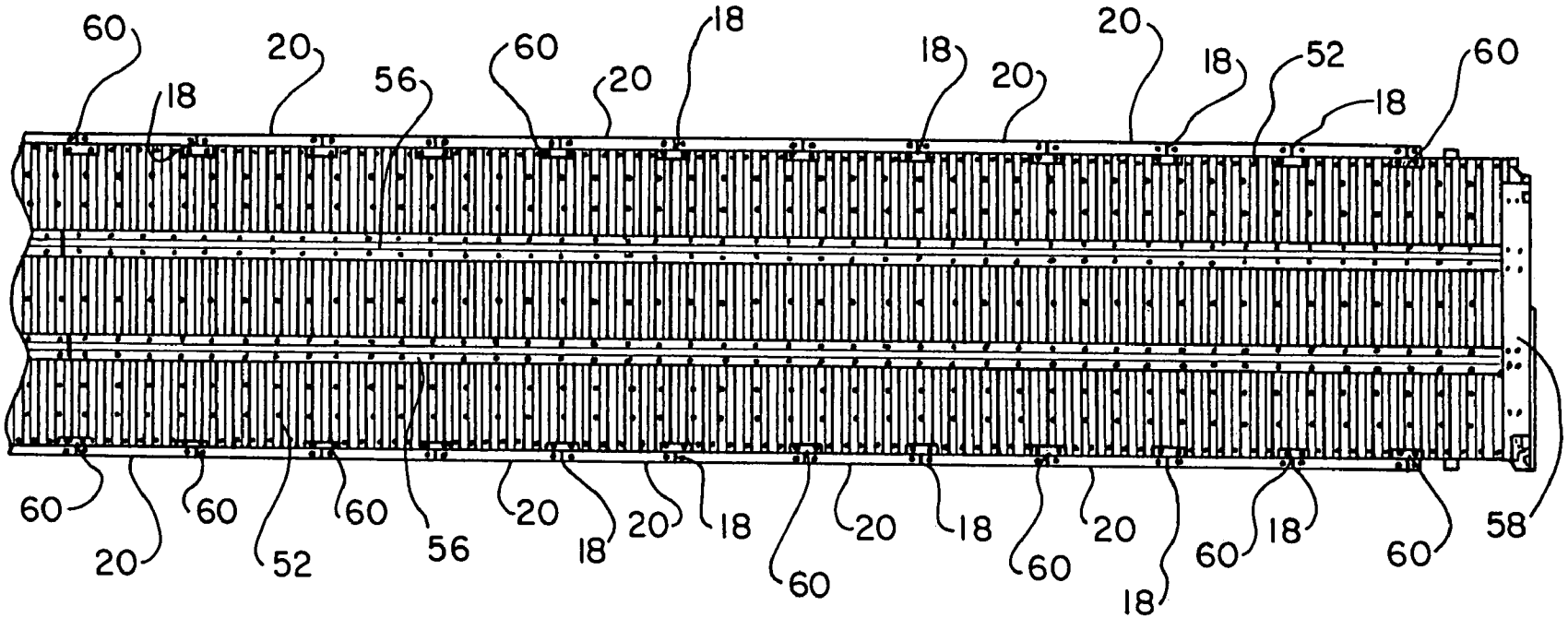
FIG. 14 is a right half plan view of the upper deck and side panel attachment of the vehicle carrier railcar shown in FIG. 12.
Figure 15:
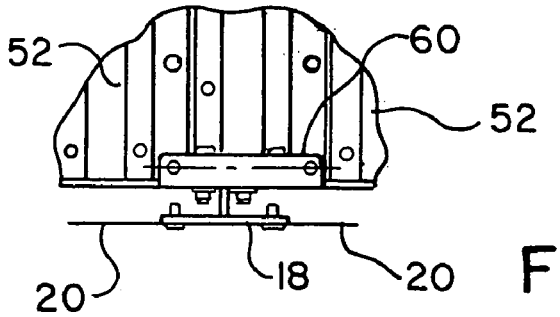
FIG. 15 is an enlarged plan view of a portion of the upper deck and side panel attachment of the vehicle carrier railcar shown in FIG. 14.
Figure 16:
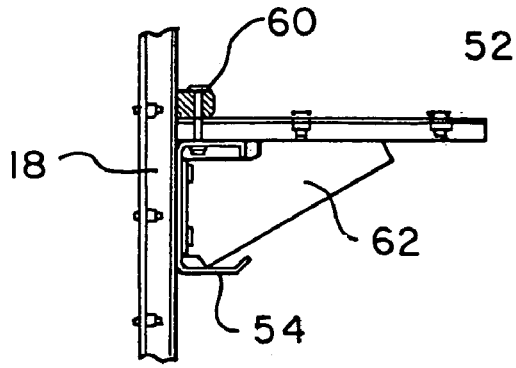
FIG. 16 is a sectional view of a portion of the upper deck and side panel attachment of the vehicle carrier railcar shown in FIG. 15.
Figure 17:
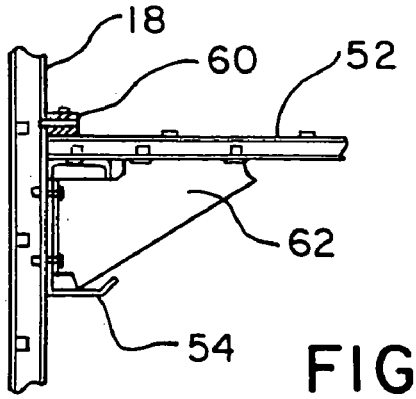
FIG. 17 is a sectional view of a portion of the upper deck and side panel attachment of the vehicle carrier railcar shown in FIG. 15.

The lower deck 36 is attached to the side panels as shown in FIGS. 6–11. Specifically, the sub-floor 40 is attached to the inner web of each side stake 18 by mechanical fasteners as shown in detail in FIGS. 9–11. Mounting blocks 46 are provided above the lower deck 36 through which mechanical fasteners secure the mounting block 46 to the adjacent side stake 18 and the mounting block 46 to the sub-floor 40. Guard plates 48 extend between the mounting blocks 46 and are attached by mechanical fasteners to the side sheets 20 and the lower deck 36 as shown in FIG. 8.

Figure 18:
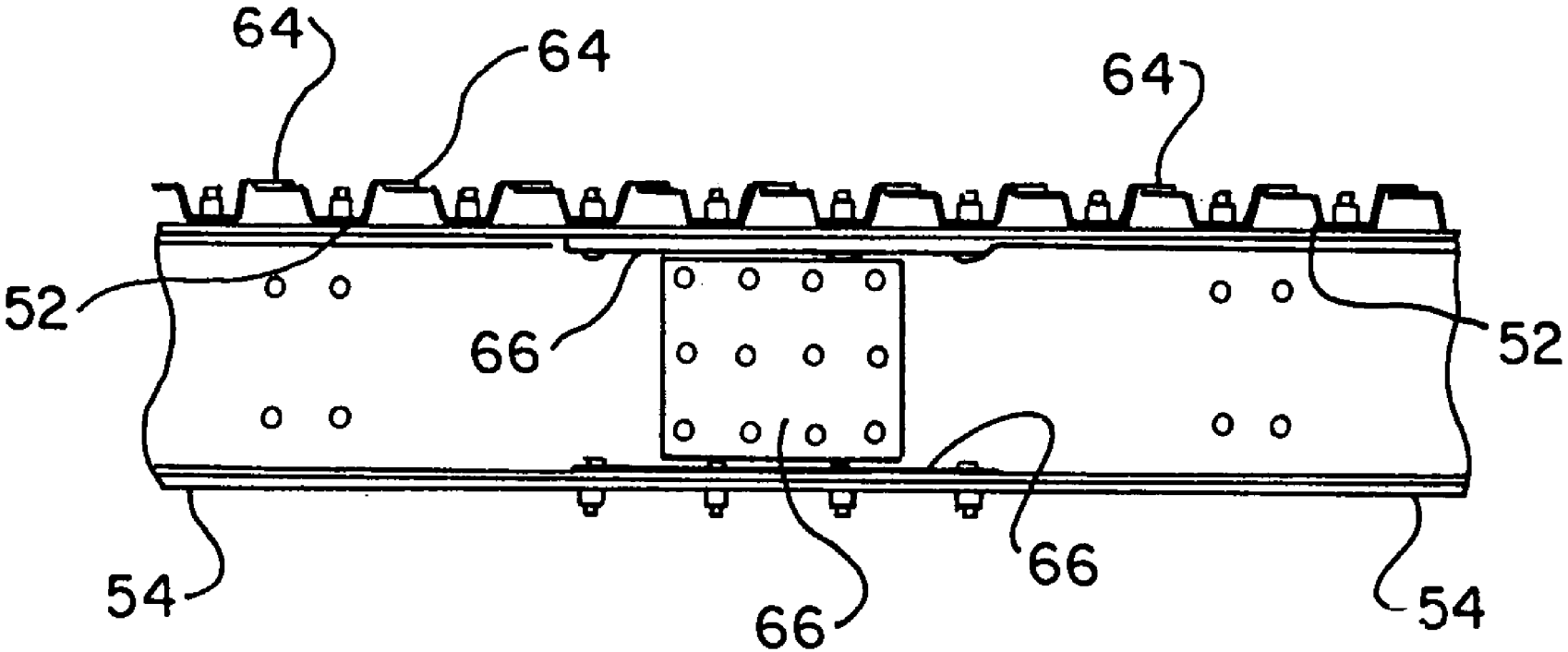
FIG. 18 is a sectional view of a portion of the upper deck of the vehicle carrier railcar shown in FIG. 12.
Figure 19:
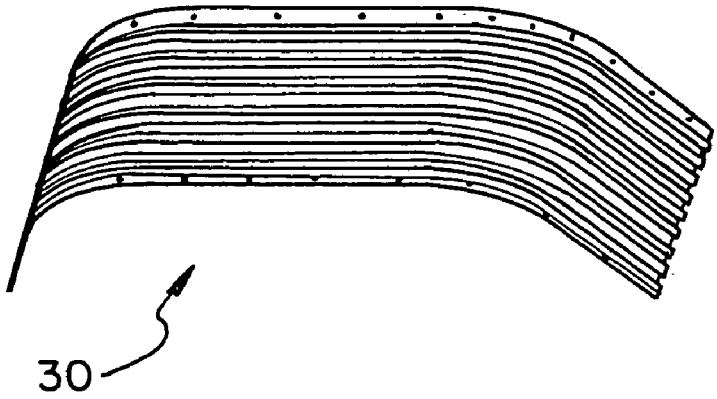
FIG. 19 is a perspective view of a corrugated roof panel of the vehicle carrier railcar shown in FIG. 1.
Figure 20:
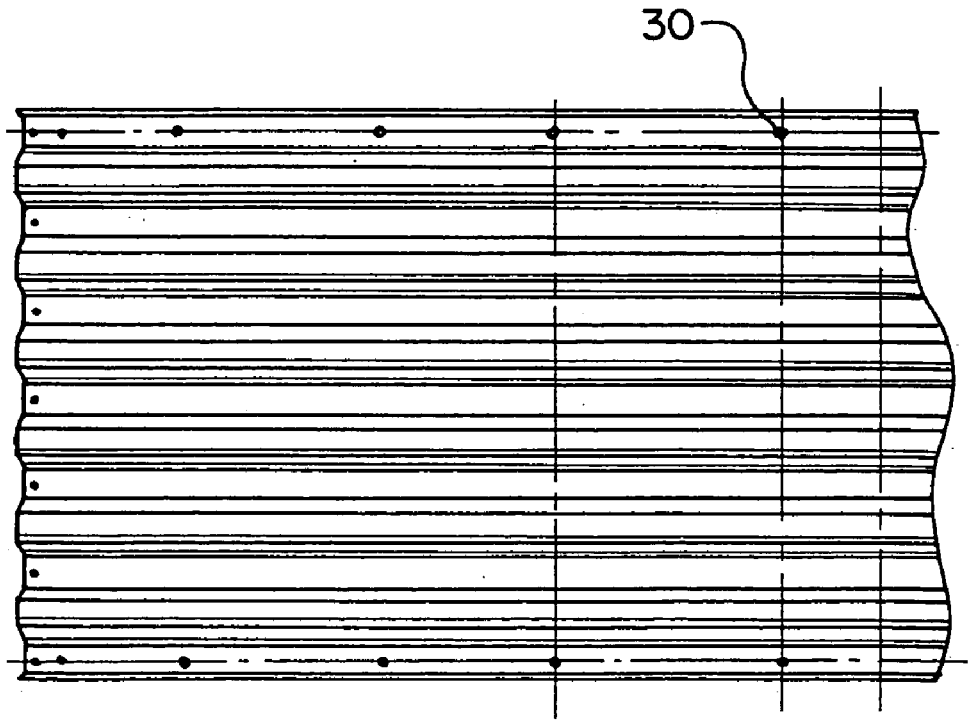
FIG. 20 is a plan view of a left half of the roof panel shown in FIG. 19.
Figure 21:
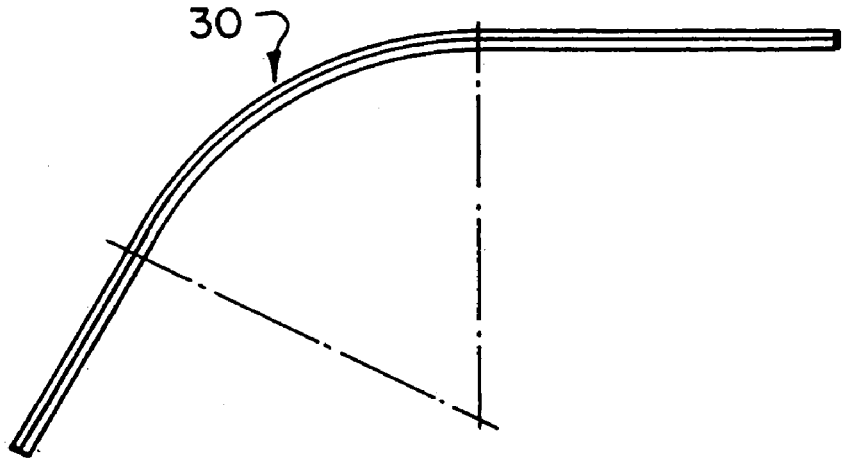
FIG. 21 is a side elevational view of the roof panel shown in FIG. 19.
Figure 22:
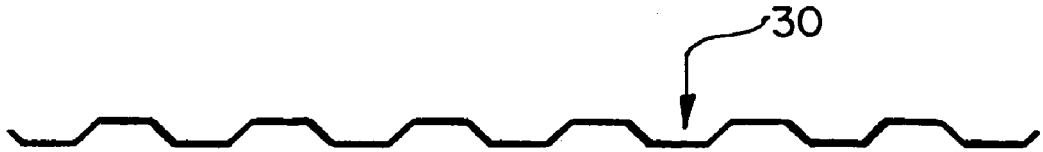
FIG. 22 is an end view of the roof panel shown in FIG. 19.

An aluminum upper deck 50 is shown in FIGS. 13–18. The upper deck 50 includes corrugated deck panels 52 attached to longitudinal extending curb plates 54 through mechanical fasteners. Tire guides 56 are attached to the deck panels 52 to assist the loading and unloading of vehicles into the railcar 10. A transition or bridge plate support 58 is provided at each end of the upper deck 50. The upper deck 50 is attached to the side panels as shown in FIGS. 13–17. Specifically, the curb plate 54 and upper deck panels 52 are attached to the inner web of each side stake 18 by mechanical fasteners as shown in detail in FIGS. 15–17. Mounting blocks 60 are provided above the upper deck 50 through which mechanical fasteners secure the mounting block 60 to the adjacent side stake 18 and the mounting block 60 to the upper deck 50. Reinforcing gussets 62 may also be provided to support the upper deck 50 and secure the upper deck 50 to the side stakes 18. Adjacent panels 52 are overlapped as shown in FIG. 18. Additionally as shown in FIG. 18 the upper surface of the extruded aluminum corrugated panels 52 includes ribs 64 to provide an anti-slip or non-skid surface for the upper deck 50. FIG. 18 also illustrates the use of splice plates 66 for connecting adjacent sections of the curb plate 54.

The above-described lower deck 36 and upper deck 50 of the present invention provides significant advantages over the known prior art. As discussed above, conventional multi-level vehicle carrier railcars are constructed from steel with the steel deck assemblies becoming slippery as vehicles are driven over the deck surface. As discussed above, the rail industry has typically required the application of a non-skid/non-slip paint on the decking surfaces. However, in the present invention with the aluminum decking formed by aluminum panels 38, 42 and 52 rust is not a significant consideration. The provision of the media blasted surface and the ribs eliminates the other need for painting the respective surfaces. Consequently, in the present invention, there is no need to paint the any deck (also referred to as the rack portion). By blasting the deck panels 38 and 42 and by including extruded ribs onto the deck panels 52, the present invention achieves a comparable anti-skid surface. When wet, the upper and lower decks 50 and 36, respectively, will not become slippery due to the roughened surface condition of the deck panels 38, 42 and 52. The process, of course, also avoids the need for repeat applications since it is relatively permanent. The present invention thereby provides an initial lower cost and significantly decreased maintenance cost.

Another advantage of the vehicle carrier railcar 10 of the present invention is that the interior is substantially all aluminum since the side walls, the decking, the roof and the doors are formed primarily of aluminum and, therefore, substantially non-corrosive. Other metal components within the interior can be formed of stainless steel or coated material or otherwise of a non-corrosive type material to essentially eliminate the rust problem in the cargo interior. The vehicle carrier railcar 10 of the present invention provides no steel facing the interior vehicle carrying cargo area. This will avoid the railcar 10 from damaging the cargo carried thereon. A further advantage of the present invention is the integration of the rack structure (i.e., decking) and the enclosed structure (i.e., the side panels, roof and doors) into a single aluminum upper structure 16. This construction significantly decreases the weight of the railcar 10 for providing an approximately 20% lighter railcar 10 with associated savings.

It will be readily apparent to those of ordinary skill in the art that various changes may be made to the present invention without departing from the spirit and scope thereof. The described embodiment is intended to be illustrative of the present invention and not restrictive thereof. The scope of the present invention is intended to be defined by the appended claims and equivalents thereto.

We claim:

1. A vehicle carrier railcar comprising:

a pair of opposed trucks;

an underframe supported on the trucks, wherein the underframe includes a center sill extending between the trucks and the center sill is a one piece cold formed center sill;

an aluminum upper structure supported on the underframe, the upper structure defining an enclosed cargo space and including an aluminum decking supporting vehicles within the cargo space, and wherein the upper structure further includes aluminum side sheets and corrugated aluminum roof decking surrounding the cargo space.

2. The railcar as claimed in claim 1 wherein the cargo space remains uncoated.

3. The railcar as claimed in claim 1 wherein the upper structure further includes aluminum side stakes.

4. The railcar as claimed in claim 1 wherein the aluminum decking that supports vehicles within the cargo space includes anti-slip features.

5. The railcar as claimed in claim 4 wherein the anti-slip features of the aluminum decking that supports vehicles within the cargo space includes at least one of extruded ribs formed in the aluminum decking that supports vehicles within the cargo space, and a media blasted finish on a surface of the aluminum decking that supports vehicles within the cargo space.

6. A vehicle carrier railcar comprising:

a pair of opposed trucks;

an underframe supported on the trucks;

an aluminum upper structure supported on the underframe, the upper structure defining an enclosed cargo space and including an aluminum decking supporting vehicles within the cargo space, wherein the aluminum decking includes anti-slip features and wherein the anti-slip features of the aluminum decking include a media blasted finish to a surface of the aluminum decking.

7. The railcar as claimed in claim 1 wherein the cargo space defines at least two levels for the vehicles including an upper level, wherein the upper level defined by at least some of the aluminum decking, wherein the aluminum decking defining the upper level includes overlapping extruded aluminum panels.

8. A multi-level vehicle carrier railcar comprising:

a pair of opposed trucks;

an underframe supported on the trucks, the underframe including a center sill extending between the trucks;

an aluminum upper structure supported on the underframe, the upper structure defining a substantially enclosed multi-level cargo space and including aluminum decking supporting vehicles within the cargo space and defining at least an upper level of the multi-level cargo space, and wherein the aluminum decking includes anti-slip features, the anti-slip features including a media blasted finish to a surface of the aluminum decking.

9. The railcar as claimed in claim 8 wherein the anti-slip features of the aluminum decking further include extruded ribs formed in the aluminum decking.

10. The railcar as claimed in claim 8, wherein the aluminum decking defining the upper level of the multi-level cargo space includes overlapping extruded aluminum panels.

11. The railcar as claimed in claim 8 wherein the upper structure further includes aluminum side stakes, aluminum side sheets and corrugated aluminum roof decking surrounding the cargo space.

12. The railcar as claimed in claim 11 wherein the upper structure defining the cargo space remains uncoated.

13. The railcar as claimed in claim 8 wherein the center sill is a one piece cold formed center sill.

* * * * *